US005131507A

United States Patent [19]

Watanabe

[11] Patent Number: 5,131,507

[45] Date of Patent: Jul. 21, 1992

[54] HYDRAULIC ELEVATOR CONTROL APPARATUS USING VVVF TO DETERMINE THE ELECTRIC DRIVE MOTOR ROTATIONAL SPEED

[75] Inventor: Eiki Watanabe, Inazawa, Japan

[73] Assignee: Mitsubishi Denki Kabushiki Kaisha, Japan

[21] Appl. No.: 537,987

[22] Filed: Jun. 13, 1990

[30] Foreign Application Priority Data

Jun. 15, 1989 [JP] Japan ..... 1-150566

[51] Int. Cl.[5] ..... B66B 9/04

[52] U.S. Cl. ..... 187/110

[58] Field of Search ..... 187/17, 29 B, 119. 111; 318/800, 798

[56] References Cited

U.S. PATENT DOCUMENTS

| | | | |
|---|---|---|---|
| 4,548,296 | 10/1985 | Hasegawa | 187/17 |
| 4,593,792 | 6/1986 | Yamamoto | 187/111 |
| 4,631,467 | 12/1986 | Herrmann et al. | 318/798 |
| 4,680,525 | 7/1987 | Kobari et al. | 318/798 |
| 4,808,903 | 2/1989 | Matsui et al. | 318/800 |
| 4,982,816 | 1/1991 | Doi et al. | 187/119 |

*Primary Examiner*—A. D. Pellinen

*Assistant Examiner*—Lawrence E. Colbert

*Attorney, Agent, or Firm*—Leydig, Voit & Mayer

[57] ABSTRACT

A hydraulic elevator control apparatus comprises an induction motor for driving a hydraulic pump which sends and receives a fluid, an inverter circuit for determining the number of rotations of the induction motor using variable-voltage variable-frequency, and a speed control apparatus which detects the voltage and current of the induction motor, calculates the number of rotations of the induction motor on the basis of the detected voltage and current, and controls the inverter circuit on the basis of the calculated number of rotations. The speed control apparatus comprises a current transformer for detecting the primary current of the induction motor, a voltage detector for detecting the primary terminal voltage of the induction motor, a magnetic-flux torque calculator for calculating a torque current calculation value and a magnetic-flux amplitude calculation value from the detected primary current and primary terminal voltage, and a frequency controller for calculating the speed calculation value on the basis of the difference between the torque current command value and the torque current calculation value calculated by the magnetic-flux torque calculator.

7 Claims, 7 Drawing Sheets

HYDRAULIC ELEVATOR CONTROL APPARATUS USING VVVF TO DETERMINE THE ELECTRIC DRIVE MOTOR ROTATIONAL SPEED

BACKGROUND OF THE INVENTION

1. Field of the Invention

The present invention relates to a submerge-type hydraulic elevator control apparatus and, in particular, to a hydraulic elevator control apparatus in which high-precision control is made possible without using a speed detector.

2. Description of the Related Art

For a speed control apparatus of a hydraulic elevator using oil pressure or the like, control systems such as a control system using a flow rate control valve, a pump control system, or a motor revolution control system have been utilized in the past.

Of these, the control system using a flow rate control valve is one in which, while an elevator is moving upward, a motor for sending and receiving pressure oil is rotated at a constant rate to return a fixed quantity of pressure oil discharged from an oil pressure pump to a tank. When a start command is given, the quantity of pressure oil to be returned to the tank is regulated and the speed of the elevator car is controlled, and while the elevator car is moving downward, the downward movement by the self-weight of the elevator car is regulated with a flow rate control valve and the speed is controlled. In this control system, since excess pressure oil is circulated during upward movement and gravitational potential energy is converted to the heat of the pressure oil during downward movement, energy loss is great and the temperature of the pressure oil increases greatly.

In contrast to this, in the pump control system and the motor revolution control system, only a required quantity of pressure oil is sent during upward movement and the above-mentioned enegy loss is suppressed by regenerative braking the motor during downward movement. However, the pump control system is one in which the discharge quantity is controlled using a variable displacement pump and because the structure of its control apparatus and the pump is complex, this system is expensive.

On the other hand, the motor revolution control system is one in which an induction motor is revolution-controlled over a wide range using a variable-voltage variable-frequency (VVVF) inverter. Because a positive displacement type pump is used in this system and its discharge quantity can be controlled by varying the revolution of an induction motor, this system is inexpensive and reliability is high.

FIG. 3 is a configurational view illustrating a conventional hydraulic elevator control apparatus in which a motor revolution control system is used, for example, disclosed in Japanese Patent Laid Open No. 60-248576. FIG. 4 is a side view illustrating the pressure oil driving section within FIG. 3, i.e., the elevator driving section. FIG. 5 is a wiring diagram illustrating the peripheral circuits of an operation instruction contactor which is not shown in FIG. 3. FIG. 6 is a block diagram illustrating the details of the speed control apparatus in FIG. 3. FIG. 7 is a waveform chart illustrating patterns.

In FIG. 3, a cylinder 2 is buried in the pit of an elevator shaft 1 and the cylinder 2 is filled with pressure oil 3. An elevator car 5 is positioned at the top of a plunger 4 supported by the pressure oil 3 via a car floor 6 and a plurality of platform floors 7 are positioned in the side wall of the elevator shaft 1. A cam 8 is disposed on the side outer wall of the elevator car 5 and a plurality of speed reduction instruction switches 9 and stop instruction switches 10 are disposed on the inner wall of the elevator shaft 1 so as to oppose the cam 8.

The pressure oil 3 in the cylinder 2 communicates with an electromagnetic selector valve 11 via a pipe 11*a*. The electromagnetic selector valve 11 functions as a check valve at all times and when an electromagnetic coil 11*b* is energized, it conducts in the reverse direction too. An oil pressure pump 12 which communicates with the electromagnetic selector valve 11 via a pipe 12*a* is rotated in both directions by a three-phase induction motor 13 so as to send and receive the pressure oil 3 between itself and the electromagnetic selector valve 11. The induction motor 13 is provided with, for example, a speed generator 14 for detecting revolution composed of a digital pulse encoder in which photo-couplers or the like are used. The oil pressure pump 12 is provided with a tank 15 for accommodating the pressure oil 3 and the pressure oil 3 is sent and received via a pipe 15*a*. As shown in FIG. 4, the oil pressure pump 12 is placed on the outside of the tank 15 together with the induction motor 13.

In FIG. 3, an inverter circuit 20 which VVVF-controls the revolution, i.e., the speed, of the induction motor 13 comprises a rectifier 21 which accepts three-phase AC power supplies R, S and T as inputs, a capacitor 22 which smooths a DC voltage from the rectifier 21, an inverter 23 which pulse-width-controls the DC voltage across both ends of the capacitor 22 and which outputs a three-phase AC voltage using VVVF, and an inverter 24 which returns a DC current from the capacitor 22 to the three-phase AC power supplies R, S and T.

Normally open contact points 30*a* to 30*c* of an operation contactor 30 (See FIG. 5) are inserted between the induction motor 13 and the inverter circuit 20.

A speed control apparatus 25 for controlling the inverter 23 outputs a control signal 25*a* on the basis of a speed reduction instruction signal 9*a* from the speed reduction instruction switches 9, a speed signal 14*a* from the speed generator 14, an operation instruction signal via the normally open contact point 30Tc of an operation instruction timer relay 30T (See FIG. 5), and an operation signal via a normally open contact point 30*d* of the operation contactor 30.

In FIG. 5, the operation instruction timer relay 30T, the operation contactor 30, the electromagnetic coil 11*b*, and a speed control apparatus 25 are each connected in parallel to the (+) and (−) of a control power supply.

A start instruction circuit 28 which is opened by a speed reduction signal 9*a* and closed by a call signal, a door closure detection signal or the like, is connected in series to the operation instruction timer relay 30T. A series circuit, composed of a normally closed contact point 10*b* of a stop instruction switch 10 (See FIG. 3) and the normally open contact point 30Ta of the operation instruction timer relay 30T, is connected in parallel to the start instruction circuit 28. Normally open contact points 29*a* and 29*b* of an abnormality detection relay (not shown) are connected separately from each other in series to the operation instruction timer relay 30T and the operation contactor 30. The normally open contact points 29*a* and 29*b* are usually closed since the abnormality detection relay is in an energized state.

The time-limit-return normally open contact point 30Tb of the operation instruction timer relay 30T is connected in series to the operation contactor 30. A normally open contact point 30*f* of the operation contactor 30, a normally open contact point 30Td of the operation instruction timer relay 30T, and a downward-movement contact point 41Db which is closed only during downward operation are connected in series to the electromagnetic coil 11*b*.

In FIG. 6 in which the speed control apparatus 25 is shown in detail, a delay circuit 40 outputs an operation instruction signal delayed by a fixed time via a normally open contact point 30Tc of the operation instruction timer relay 30T. An upward travelling pattern generation circuit 41U and the downward travelling pattern generation circuit 41D each generate predetermined travelling patterns by an operation signal delayed by the delay circuit 40 and switch the travelling pattern to a low speed by the speed reduction instruction signal 9*a*. An upward-movement contact point 41Ua, which is closed only during upward operation, is connected to the output terminal of the upward travelling pattern generation circuit 41U. A downward-movement contact point 41Da, which is closed only during downward operation, is connected to the output terminal of the downward travelling pattern generation circuit 41D.

A bias pattern generation circuit 45 generates a bias pattern for rotating the oil pressure pump 12 at a number of rotations corresponding to the quantity of the pressure oil 3 leaking from the oil pressure pump 12 at this time according to an operation signal via the normally open contact point 30*d* of the operation contactor 30 and an operation instruction signal via the normally open contact point 30Tc and sets the bias pattern to zero by the stop instruction signal as the result of the opening of the normally open contact point 30*d*. An adder 46 adds the bias pattern to either one of the outputs of the travelling pattern generation circuits 41U and 41D.

A conversion circuit 47 makes the level of a speed signal 14*a* match with the level of travelling patterns. A subtracter 48 calculates the difference between the outputs of the adder 46 and the conversion circuit 47 and inputs the subtraction result to a transmission circuit 49. An adder 50 adds the output of the conversion circuit 47 to the output amplified by the transmission circuit 49 and outputs a frequency command signal $\omega 0$. A function generator 51 outputs a voltage command signal V which varies linearly with respect to the frequency command signal $\omega 0$. A reference sine-wave generation circuit 52 outputs a control signal 25*a* to an inverter 23 on the basis of the frequency command signal $\omega 0$ and voltage command signal V. The inverter 23 generates a three-phase AC voltage of a sine wave by this control signal 25*a*.

Shown in FIG. 7 are a bias pattern P1, a travelling pattern P2 during downward movement, a motor pattern P3 corresponding to the number of rotations of the induction motor 13, a car speed pattern P4 of the elevator car 5, and a pressure oil flow rate pattern P5 corresponding to an actual output. A concrete operation of a conventional hydraulic elevator control apparatus shown in FIGS. 3 to 6 will be explained with reference to the waveform charts of these patterns. Since only the polarity differs in the upward and downward travelling patterns, only the travelling pattern P2 during downward movement will be explained.

Suppose that the elevator car 5 is in a stopped state and a call in a downward direction is generated, then a start instruction is input to the elevator car 5 after the door is closed. At this time, the operation instruction timer relay 30T is energized. This energized state is self-held by the closing of the normally open contact point 30Ta and the normally open contact points 30Tb to 30Td are closed.

The closing of the normally open contact point 30Tb causes the operation contactor 30 to be energized and the normally open contact points 30*a* to 30*c* of FIG. 3 and the normally open contact point 30*f* of FIG. 5 are closed. The closing of the normally open contact points 30*a* to 30*c* causes the induction motor 13 to be connected to the inverter 23 and is supplied with electricity. The closing of the normally open contact points 30Tc and 30*d* causes the bias pattern generation circuit 45 of FIG. 6 to generate the bias pattern P1 at time t0, as shown in FIG. 7. This bias pattern P1 causes the inverter 23 to generate a low three-phase voltage of a low frequency and the induction motor 13 drives the oil pressure pump 12 at a low number of rotations corresponding to the quantity of pressure oil leaked from the oil pressure pump 12. Therefore, the elevator car 5 does not move upward by the driving from the bias pattern P1 and remains in a stopped state.

Since the normally open contact points 41Da and 41Db are closed during downward operation, the closing of the normally open contact points 30*f*, 30Td, and 41Db causes the electromagnetic coil 11*b* to be energized and the electromagnetic selector valve 11 is opened and becomes fully opened at time tp.

At time t1, after a certain time has elapsed since the normally open contact point 30Tc is closed by the energization of the operation instruction timer relay 30T, the delay circuit 40 generates an output and the downward travelling pattern generation circuit 41D generates the travelling pattern P2 which rises at time t1, as shown in FIG. 7. At this time, the travelling pattern P2 is added to the bias pattern P1 by the adder 46, the induction motor 13 lowers its revolution gradually, as shown in the motor pattern P3, and rotates in a reverse direction from the zero revolution. As a result, the elevator car 5 travels downward, as shown in the car speed pattern P4, and arrives at a constant speed at time t2.

When the elevator car 5 moves downward, and, shortly before it reaches a required position on an object floor, the cam 8 actuates the speed reduction instruction switches 9 to generate a speed reduction instruction signal 9*a*. As a result, a pattern signal from the downward travelling pattern generation circuit 41D decreases and the elevator car 5 is slowed down at time t3 to a fixed low-speed at time $t_4$ and continues to move downward. At this time, the start instruction circuit 28 is opened by the speed reduction instruction signal 9*a*. Therefore, when the cam 8 actuates the stop instruction switch 10 at time t5 and the normally closed contact point 10*b* is opened, the operation instruction timer relay 30T is de-energized. As a result, since the output from the downward travelling pattern generation circuit 41D falls to zero, the speed of the car further decreases and the elevator car 5 stops at time t6. At this time, even if the operation instruction timer relay 30T is de-energized, the normally open contact point 30Tb makes a time-limit return after the normally open contact point 30Tb is held closed for a fixed time. Therefore, the operation contactor 30 is kept in an energized state and the induction motor 13 continues to be rotated by the bias pattern P1.

On the other hand, the operation instruction timer relay 30T is de-energized by the operation of the stop instruction switch 10 and the normally open contact point 30Td is opened. Therefore, the electromagnetic coil **11*b* is de-energized and the electromagnetic selector valve 11 is gradually closed and is fully closed at time tD. As a result, the supply of the pressure oil 3 to the tank 15 from the cylinder 2 is stopped and the elevator car 5** is kept in a stopped state.

When the normally open contact point 30Tb is opened at time t7 and the operation contactor 30 is de-energized, the normally open contact points **30*a* to 30*f* are opened. As a result, power supply to the induction motor 13 is shut off, the bias pattern generation circuit 45 stops the outputting of the bias pattern P1 and the induction motor 13** stops at time t8.

On the other hand, the operation of the elevator car 5 during upward movement is the reverse of the case where the rotation direction of the induction motor 13 is downward, and is almost the same as the above except that the electromagnetic selector valve 11 is left closed. As described above, the control system using the inverter 23 exhibits excellent performance in a fluid pressure elevator.

In recent years, however, as shown in FIG. 8, for the purpose of further preventing noise and achieving a smaller type, a submerge system, in which an elevator driving section including the oil pressure pump 12 and the induction motor 13 are immersed in the tank 15, has come to be adopted. In this case, since the speed generator 14 as well as the electromagnetic selector valve 11, the oil pressure pump 12 and the induction motor 13 are immersed in the pressure oil 3 in the tank 15, an optical pulse encoder or the like cannot be used for the speed generator 14.

Therefore, for example, as disclosed in Japanese Patent Laid Open No. 64-34881, an arrangement in which only the rotation shaft of the induction motor 13 is made to project outside the tank 15 and the speed generator 14 is placed on the projected portion of the induction motor 13 has been proposed. Actually, however, since the pressure oil 3 flows out of the tank 15 through the rotation shaft of the speed generator 14, this arrangement is also not practical.

As described above, the conventional hydraulic elevator control apparatus has problems in that, since the speed generator 14 is used to control the speed or the induction motor 13, the speed generator 14 must be placed directly in the driving section. This speed generator is of little practical use in a submerge type hydraulic elevator control apparatus and the number of rotations of the induction motor cannot be satisfactorily controlled.

SUMMARY OF THE INVENTION

The present invention has been devised to solve the problems described above. An object of the present invention is to obtain a hydraulic elevator control apparatus which is capable of controlling the number of rotations of an induction motor without using a speed generator.

The hydraulic elevator control apparatus of the present invention comprises an induction motor which drives a hydraulic pump which sends and receives a fluid, an inverter circuit which determines the number of rotations of the induction motor according to the VVVF, and a speed control apparatus which detects the voltage and current of the induction motor, calculates the number of rotations of the induction motor on the basis of the detected voltage and current, and controls the inverter circuit on the basis of this number of rotations.

According to the present invention, since the number of rotations of an induction motor is controlled without using a speed generator, high-accuracy speed control using a VVVF inverter is made possible for a submerge-system hydraulic elevator control apparatus.

These and other objects, features and advantages of the present invention will become clear when reference is made to the following description of the preferred embodiments of the present invention, together with reference to the accompanying drawings.

DESCRIPTION OF THE PREFERRED EMBODIMENTS

An embodiment of the present invention will be explained with reference to the accompanying drawings.

Figure 1:
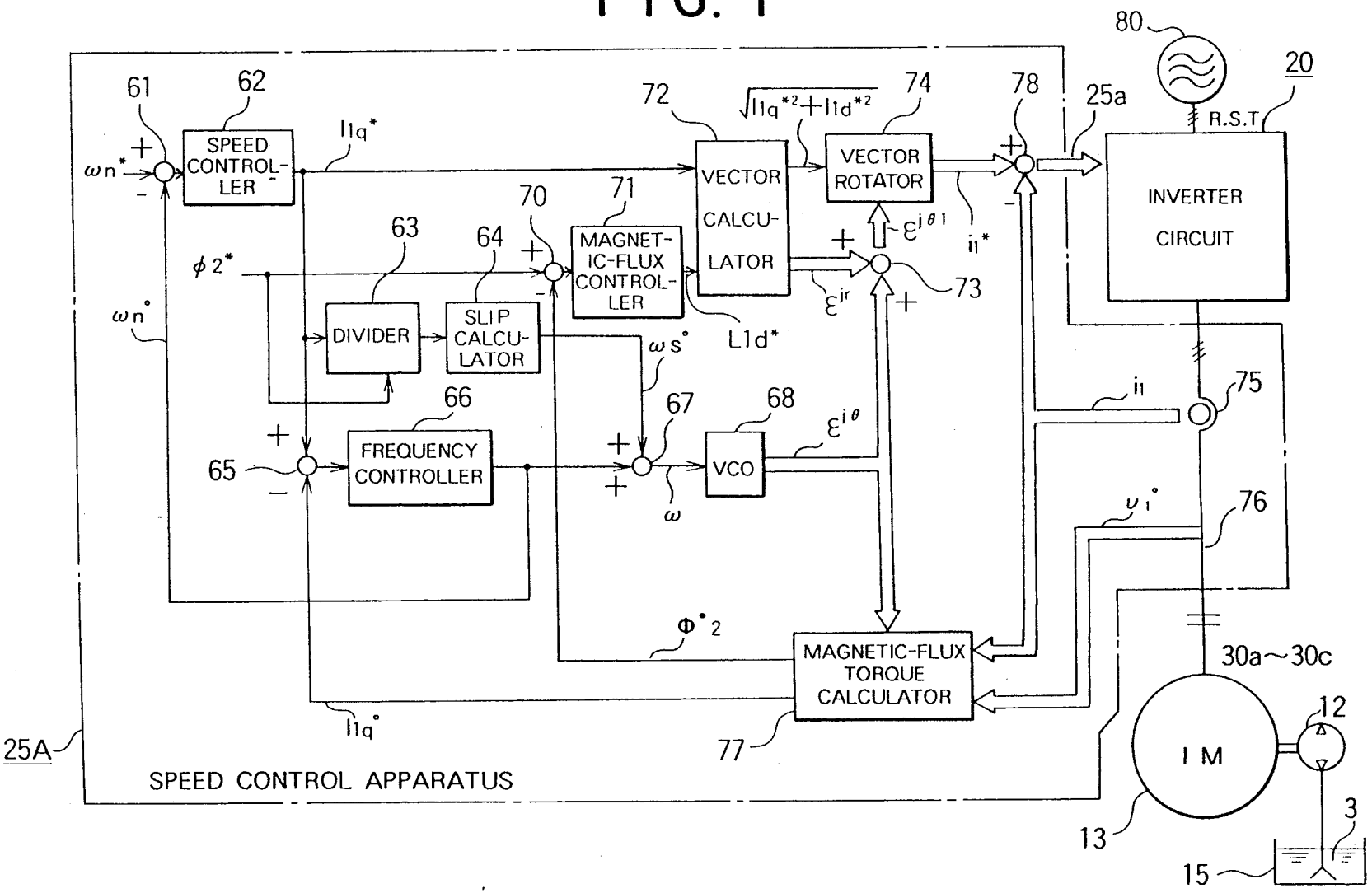
FIG. 1 is a function block diagram illustrating one embodiment of the present invention.

In FIG. 1, the pressure oil 3 is accommodated in the tank 15 and this pressure oil 3 is supplied to a cylinder (not shown) for moving an elevator car by means of the oil pressure pump 12. The induction motor 13 for driving this cylinder is connected to the oil pressure pump 12. An inverter circuit 20 is connected to the induction motor 13 via the normally open contact points **30*a* to 30*c* of an operation contactor (not shown) and the speed control apparatus 25A. A three-phase AC power supply 80 is connected to the inverter circuit 20**.

The speed control apparatus 25A has a current transformer 75 for detecting the primary current il of the induction motor 13 and a voltage detector 76 for detecting the primary terminal voltage $v1^0$ of the induction motor 13. A magnetic-flux torque calculator 77 for calculating a magnetic-flux amplitude calculation value $\Phi_2{}^0$ and a torque current calculation value $Ilq^\circ$ is connected to the current transformer 75 and the voltage detector 76. The speed control apparatus 25A comprises a subtracter 61 for calculating the difference between an angular velocity command $\omega n^*$ and an angular velocity calculation value $\omega n^0$, a speed controller 62 for outputting a torque current command $I1q^*$ in correspondence to the speed deviation from the subtracter 61, a divider 63 for dividing the torque current instruction $I1q^*$ by a magnetic-flux instruction $\Phi_2{}^*$, a slip calculator 64 for outputting a slip angular velocity $\omega s^0$ on the basis of the division result of the divider 63, a subtracter 65 for calculating the difference between the torque current command $I1q^*$ and the torque current calculation value $I1q^0$, a frequency controller 66 for outputting an angular velocity calculation value $\omega n^0$ under the PI control on the basis of the current deviation from the subtracter 65, an adder 67 for adding the slip angular velocity $\omega s^0$ to the angular velocity calculation value $\omega n^0$ and outputting a magnetic-field angular velocity $\omega$, a voltage controlled oscillator (VCO) 68 for time-integrating the magnetic-field angular velocity $\omega$ and converting it to $\epsilon^{j\theta}$, a subtracter 70 for calculating the difference between the magnetic-flux command $\Phi_2^*$ and the magnetic-flux amplitude calculation value $\Phi_2^0$, a magnetic-flux controller 71 for outputting a primary current command $I1d^*$ on the basis of a magnetic-flux deviation from the subtractor 70, a vector calculator 72 for performing vector calculation on the basis of the torque current command $I1q^*$ and the primary current command $I1d^*$, an adder 73 for calculating the addition of the output signal $\epsilon^{j\gamma}$ from the vector calculator 72 to the output signal $\epsilon^{j\theta}$ from the VCO 68, a vector rotor 74 for outputting a current instruction value $I1^*$ on the basis of an output signal $(I1q^{*2}+I1d^{*2})^{\frac{1}{2}}$ from the vector calculator 72 and an output $\epsilon^{j\theta 1}$ from the adder 73, and a subtracter 78 for calculating the difference between the current command value $i1^*$ and the primary current il and outputting the control signal 25*a* to the inverter circuit 20.

The $\theta$, $\gamma$ and $\theta 1$ relating to the Output signal $\epsilon^{j\theta}$ from the VCO 68, the output signal $\epsilon^{j\gamma}$ from the vector calculator 72 and the output $\epsilon^{j\theta 1}$ from the adder 73 are each represented as follows:

$$\theta=\omega t$$

$$\gamma=tan^{-1}(I1q^*/I1d^*)$$

$$\theta_1=\omega t+\gamma.$$

Since the speed control circuit 25A is an electronic circuit in which a speed detector is not contained, it is placed outside the tank 15 together with the inverter circuit 20 and it does not pose any problem if the circuit 25A is used in a submerge-type hydraulic elevator control apparatus.

Figure 2:
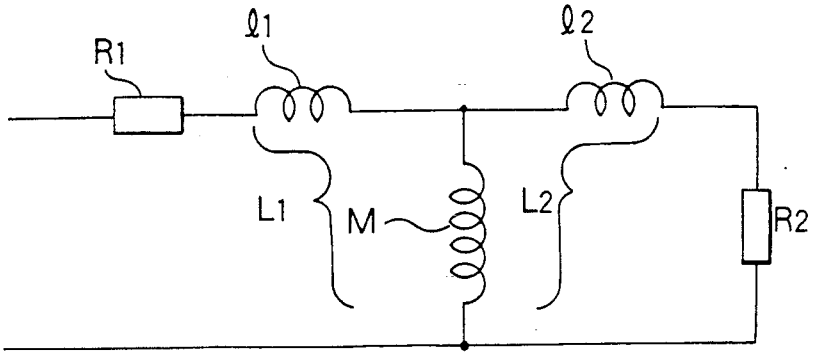
FIG. 2 is an equivalent circuit diagram of an induction motor of the present invention.
Figure 3:
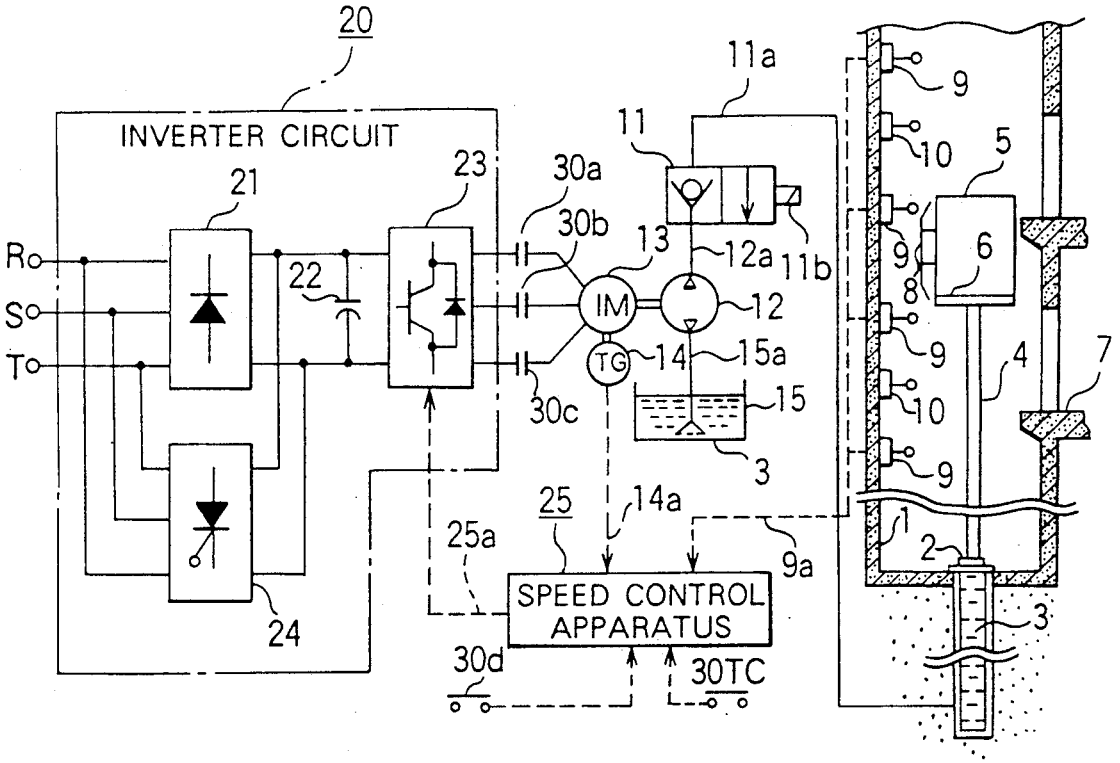
FIG. 3 (PRIOR ART)
FIG. 3 is a configurational view illustrating a conventional hydraulic elevator control apparatus.
Figure 4:
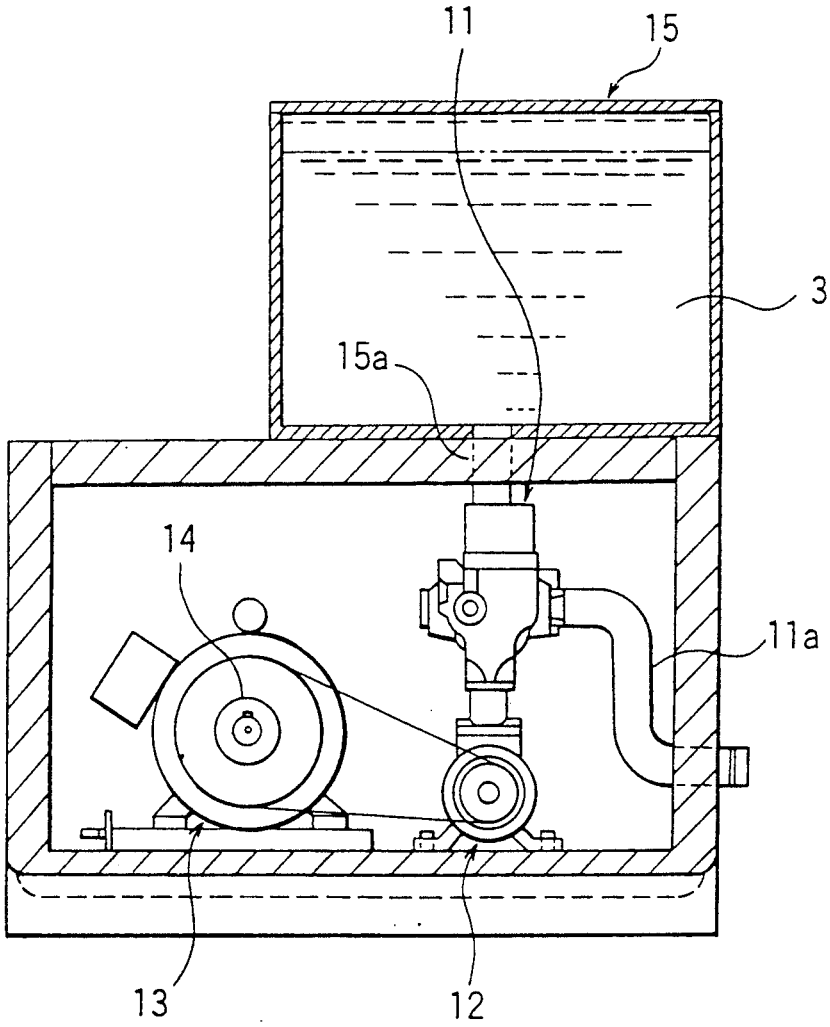
FIG. 4 (PRIOR ART)
FIG. 4 is a cross-sectional view illustrating the structure of an elevator driving section of the conventional hydraulic elevator control apparatus in FIG. 3.
Figure 5:
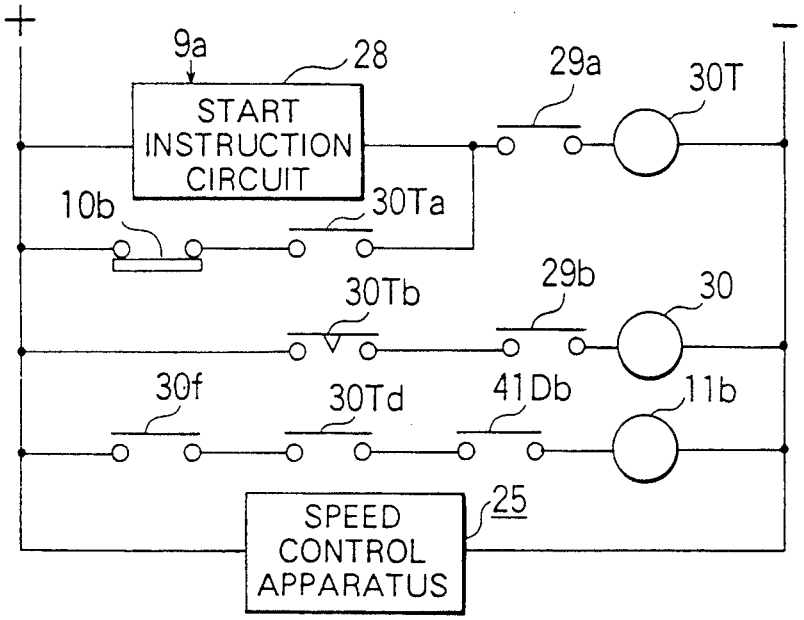
FIG. 5 (PRIOR ART)
FIG. 5 is a wiring diagram illustrating the peripheral circuits of a conventional operation contactor.
Figure 6:
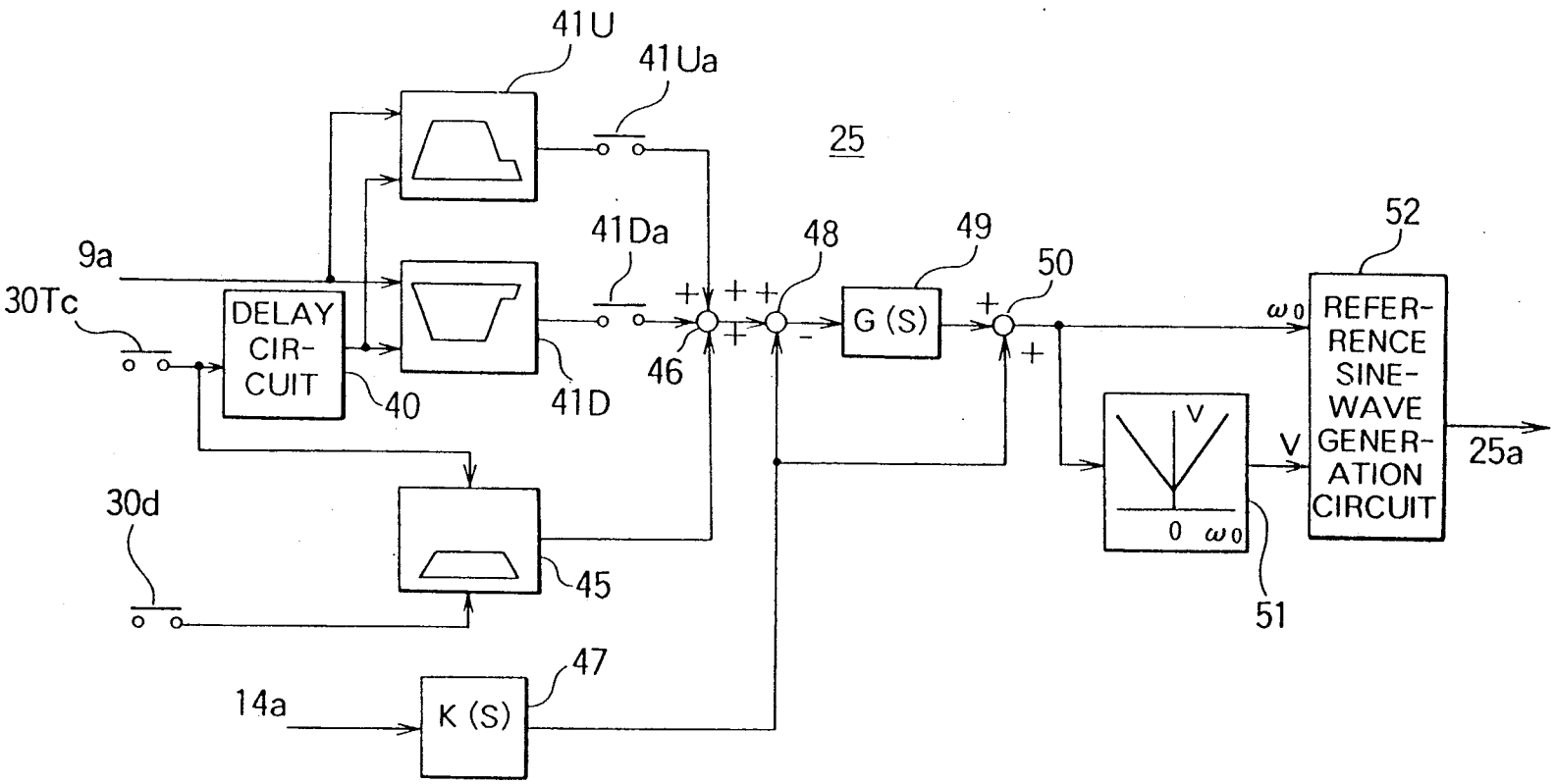
FIG. 6 (PRIOR ART)
FIG. 6 is a block diagram illustrating a conventional speed control apparatus.
Figure 7:
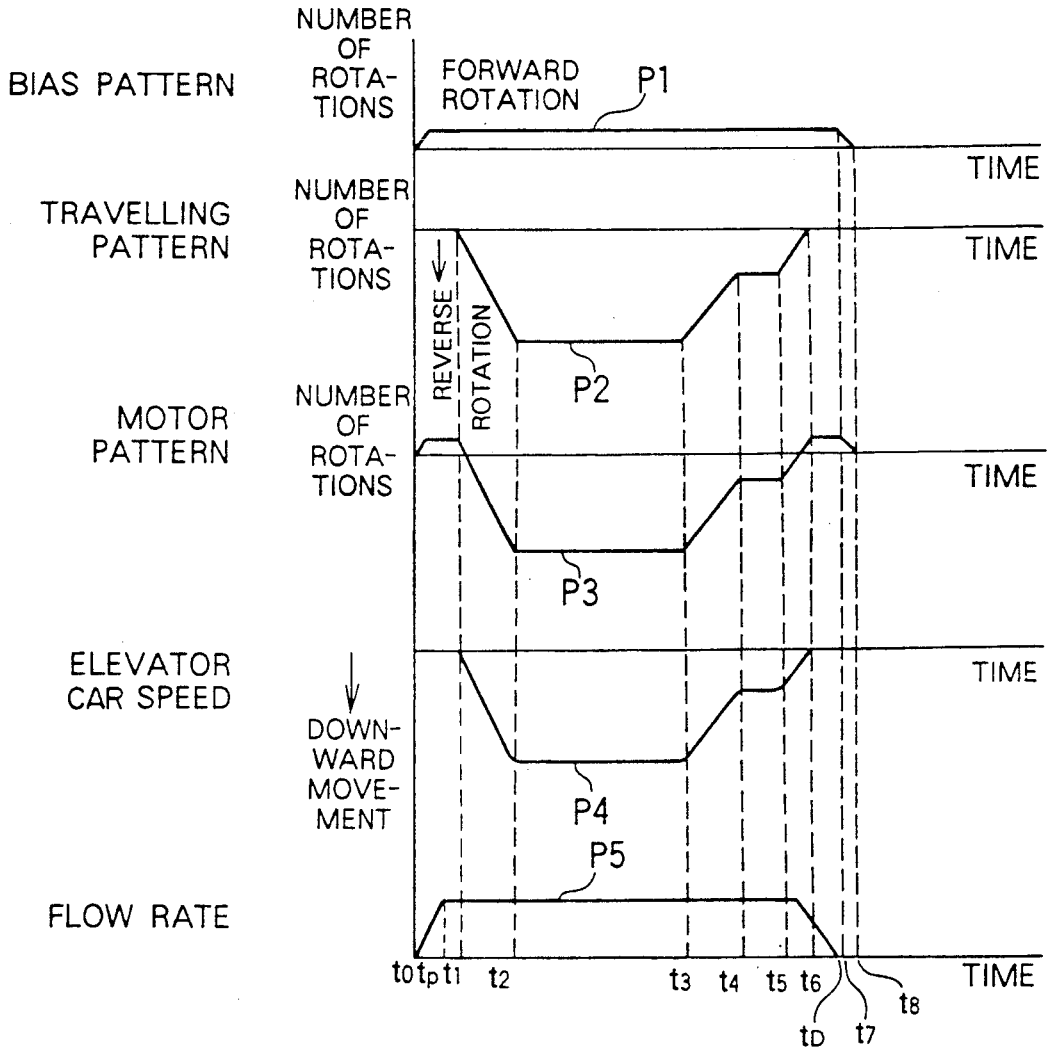
FIG. 7 (PRIOR ART)
FIG. 7 is a pattern waveform chart for explaining the operation of the conventional hydraulic elevator control apparatus.
Figure 8:
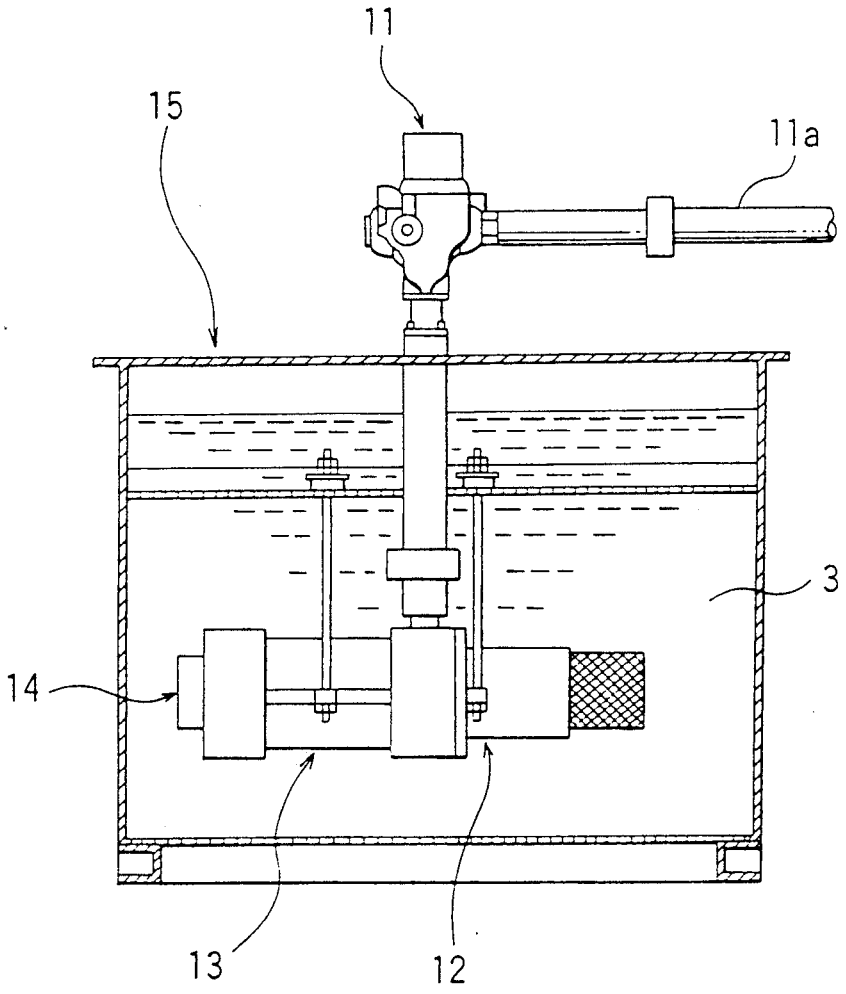
FIG. 8 (PRIOR ART)
FIG. 8 is a cross-sectional view illustrating the structure of a submerge-type elevator driving section of the conventional hydraulic elevator control apparatus.

FIG. 2 is an equivalent circuit diagram of the induction motor 13 showing the case where the induction motor 13 is of two poles and is a two-phase model. The induction motor 13 consists of a primary resistor R1, a primary leakage inductance l1, a secondary leakage inductance l2 and a secondary resistor R2 which are connected in series to each other, and an exciting inductance M between both ends of the secondary leakage inductance l2 and the secondary resistor R2. The sum of the primary leakage inductance Il and the exciting inductance M is a primary self-inductance L1 and the sum of the secondary leakage inductance I2 and the exciting inductance M is a secondary self-inductance L2.

Next, the operation of the embodiment shown in FIG. 1 will be explained with reference to FIG. 2.

The vector control is one intended to obtain a controllability equivalent to that of a DC machine by controlling, without interference and separately from each other, a secondary circuit interlinked magnetic-flux (secondary magnetic-flux) and a secondary current related to the generation of an electrical torque.

This theory can be derived from the following basic equation. The relation between the voltage and the current of the induction motor 13 in the biaxial coordinates (d, q) on a magnetic field that rotates at an angle speed $\omega$ is expressed by $$\begin{bmatrix} V1d \\ V1q \\ 0 \\ 0 \end{bmatrix} = \begin{bmatrix} R1+L1P & -L1\omega & MP & -M\omega \\ L1\omega & R1+L1P & M\omega & MP \\ MP & -M\omega s & R2+L2P & -L2\omega s \\ M\omega s & MP & L2\omega s & R2+L2P \end{bmatrix} \cdot \begin{bmatrix} I1d \\ I1q \\ I2d \\ I2q \end{bmatrix} \quad (1)$$

In equation (1),

V1d, V1q: primary voltage in d and q axes
I1d, I1q: primary current in d and q axes
I2d, I2q: secondary current in d and q axes
$\omega$: magnetic-field angular velocity
$\omega s$: slip angular velocity
P: differential operator
R1: primary resistance value
R2: secondary resistance value
M: exciting inductance
L1: primary self-inductance
L2: secondary self-inductance
i1: primary leakage inductance
i2: secondary leakage inductance At this point, if the d and q components of the secondary magnetic flux are denoted by $\Phi 2d$ and $\Phi 2q$ respectively and the following is set:

$$\Phi 2d=M\cdot I1d+L2\cdot I2d \quad (2)$$

$$\Phi 2q=M\cdot I1q+L2\cdot I2q. \quad (3)$$

then, the following equation holds:

$$0=R2\cdot I2d+-\Phi 2d-\omega s\cdot\Phi 2q \quad (4)$$

$$0=R2\cdot I2q+-\Phi 2q-\omega s\cdot\Phi 2d \quad (5)$$

An electrical torque Te is expressed by $$Te=\Phi 2d\cdot I2q-\Phi 2q\cdot I2d \quad (6)$$

If the axis of the secondary magnetic-flux vector is represented as the d axis and $\Phi 2q=0$ is set, equation (6) becomes $$\begin{aligned} Te &= \Phi 2d\cdot I2q \\ &= -M/L2\cdot\Phi 2d\cdot I1q \end{aligned} \quad (7)$$

In this case, it is known that the electrical torque Te can be expressed by the secondary magnetic flux $\Phi 2d$ and the torque current conversion value I1q.

Therefore, if $\Phi 2q=0$ can be realized, the electrical torque Te can be controlled by the secondary magnetic flux $\Phi 2d$ and the torque current conversion value I1q.

As a method for realizing secondary magnetic-flux vector control, i.e., vector control, the slip frequency control method, the magnetic-field orientation method or the like are available. Here, however, the vector control method by means of the torque component current (torque current conversion value) frequency feedback control will be described.

The rotor angular velocity $\omega n$ of the induction motor 13 can be expressed as in the following by using the magnetic-field angular velocity $\omega$ and the slip angular velocity $\omega s$:

$$\omega n = \omega - \omega s \quad (8)$$

From the above, its speed can be determined.

In the above, the magnetic-field angular velocity $\omega$ can be determined directly from the control apparatus in the inverter circuit 20, and the slip angular velocity $\omega s$ can be expressed as follows:

$$\begin{aligned} \omega s &= -R2 \cdot I2q/\Phi 2d \\ &= (M/L2) \cdot R2 \cdot I1q/\Phi 2d \\ &= (1/T2) \cdot I1q/I1d \end{aligned} \quad (9)$$

the result of the realization of the vector control, if an instruction value and the constant of the induction motor 13 are used, the slip angular velocity $\omega s^0$ is expressed as follows:

$$\begin{aligned} \omega s^0 &= \{(M/L2) \cdot R2 \cdot I1q/\Phi 2d\}^* \\ &= \{(1/T2) \cdot I1q/I1d\}^* \end{aligned} \quad (10)$$

Therefore, the angular velocity calculation value $\omega n^0$ can be estimated from the calculation of $$\omega n^0 = \omega - \omega s^0 \quad (11)$$

In the above equations (9) to (11), T2 is a secondary circuit time constant and expressed as follows:

$$T2 = L2/R2.$$

Those in $\{\}^*$ indicate set values or command values.

The above-mentioned calculation functions can be realized by the system configuration of FIG. 1. That is, the angular velocity difference between the $\omega n^*$ and the angular velocity calculation value mn° becomes the torque current command $I1q^*$ through the speed controller 62, and this torque current command $I1q^*$ is subtracted by the torque current calculation value $I1q^*$ calculated by the magnetic-field torque calculator 77 and becomes a current deviation. This current deviation is added with the slip angular velocity $\omega s^0$ by the adder 67 via the frequency controller 66 and is input to the VCO 68. As a result, the magnetic-field angular velocity $\omega$ is controlled so as for the torque current calculation value $I1q^0$ to match the torque current command $I1q^*$, with the result that it matches the slip angular velocity $\omega s^0$ suited to the actual constant of the induction motor 13. The primary current command $I1d^*$ and the torque current command $I1q^*$ are converted to an AC current command value $i1^*$ via the vector calculator 72 and the vector rotator 74 and after the $i1^*$ is subtracted by the i1 with the subtracter 78, it is input to the inverter circuit 20. As a result, the primary current il of the induction motor 13 is controlled to a desired current value.

As has been described, by calculating the number of rotations of the induction motor 13 on the basis of the voltage and current of the induction motor 13, it is made possible to control the speed of an elevator without using a speed generator.

In the above-mentioned embodiment, as the speed control apparatus 25A, a vector control circuit is used. However, other control circuits may be used if it is a control circuit in which a speed detector is not used.

Many widely different embodiments of the present invention can be made without departing from the spirit and scope thereof, therefore it is to be understood that this invention is not limited to the specific embodiments thereof except as defined in the appended claims.

What is claimed is:

1. An hydraulic elevator control apparatus, comprising:

an induction motor for driving a hydraulic pump for sending and receiving a fluid;

an invertor circuit for determining a number of rotations of said induction motor using VVVF; and a vector control circuit which detects a primary voltage and a primary current of said induction motor, calculates a number of rotations of said induction motor on the basis of the detected primary voltage and the primary current, and transmits a control signal to said invertor circuit which controls the speed of an elevator cage.

2. An hydraulic elevator control apparatus according to claim 1, wherein said vector control circuit comprises:

a current transformer for detecting the primary current of said induction motor;

a voltage detector for detecting the primary terminal voltage of said induction motor;

a magnetic-flux torque calculator for calculating a torque current calculation value and a magnetic-flux amplitude calculation value from the detected primary current and primary terminal voltage; and a frequency controller for calculating a speed calculation value on the basis of a difference between a torque current command value and the torque current calculation value calculated by said magnetic-flux torque calculator.

3. An hydraulic elevator control apparatus according to claim 2, wherein said vector control circuit comprises:

a divider for calculating a ratio of said torque current instruction value to a magnetic-flux instruction value;

a slip calculator for calculating a slip angular velocity on the basis of the division result in said divider;

an adder for calculating a magnetic-field angular velocity by adding said velocity calculation value to the slip angular velocity;

a voltage controlled oscillator for time-integrating the magnetic-field angular velocity;

a magnetic-flux controller for calculating a primary current instruction value on the basis of the difference between a magnetic-flux command value and the magnetic-flux amplitude calculation value calculated by said magnetic-flux torque calculator;

a vector calculation means for performing vector calculation of said torque current command value and said primary current command value and for calculating the current instruction value on the basis of the calculated result and the time-integrated result by said voltage calculated oscillator; and a subtractor for calculating the difference between said current command value and the primary current detected by said current transformer and outputting it to said inverter circuit as a control signal.

4. An hydraulic elevator control apparatus, comprising:

an induction motor an invertor circuit for determining a number of rotations of said induction motor using VVVF; and a vector control circuit which detects a primary voltage and a primary current of said induction motor, calculates a number of rotation of said induction motor on the basis of the detected primary voltage and primary current, and transmits a control signal to said invertor circuit which controls the speed of an elevator cage.

5. An hydraulic elevator control apparatus according to claim 4, where said induction motor is a two phase motor.

6. An hydraulic elevator control apparatus according to claim 4, where said induction motor is a two pole motor.

7. An hydraulic elevator control apparatus, comprising:

an induction motor for driving a hydraulic pump, wherein the induction motor and the hydraulic pump are immersed in a tank containing a fluid;

an invertor circuit for determining a number of rotations of said induction motor using VVVF; and a control circuit which detects a primary voltage and a primary current of said induction motor, calculates a number of rotations of said induction motor on the basis of the detected primary voltage and primary current, and transmits a control signal to said invertor circuit which controls the speed of an elevator cage.

* * * * *